US009280091B2

(12) United States Patent
Morita

(10) Patent No.: US 9,280,091 B2
(45) Date of Patent: Mar. 8, 2016

(54) TONER CONVEYING DEVICE AND IMAGE FORMING APPARATUS INCLUDING THE SAME

(71) Applicant: KYOCERA Document Solutions Inc., Osaka-shi, Osaka (JP)

(72) Inventor: Takashi Morita, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/616,963

(22) Filed: Feb. 9, 2015

(65) Prior Publication Data

US 2015/0227084 A1 Aug. 13, 2015

(30) Foreign Application Priority Data

Feb. 12, 2014 (JP) ..... 2014-024474

(51) Int. Cl.
*G03G 15/08* (2006.01)

(52) U.S. Cl.
CPC ..... *G03G 15/0886* (2013.01); *G03G 15/0877* (2013.01); *G03G 15/0879* (2013.01)

(58) Field of Classification Search
CPC ..... G03G 15/0877; G03G 15/0879; G03G 15/0886
USPC ..... 399/258
See application file for complete search history.

(56) References Cited

U.S. PATENT DOCUMENTS 4,841,333 A * 6/1989 Damji ..... 399/114
6,026,253 A * 2/2000 Domon et al. ..... 399/30
8,600,267 B2 12/2013 Sato
2007/0065184 A1 3/2007 Sato
2008/0025758 A1 1/2008 Sato
2008/0253804 A1* 10/2008 Furuta et al. ..... 399/119
2009/0060585 A1 3/2009 Ishiguro et al.

(Continued)

FOREIGN PATENT DOCUMENTS

EP 1767999 A2 3/2007
EP 1890199 A2 2/2008
JP 2011191618 A 9/2011

OTHER PUBLICATIONS

European Patent Office, Extended European Search Report Issued in Application No. 15154261.0, Aug. 6, 2015, Germany, 8 pages.

*Primary Examiner* — David Gray
*Assistant Examiner* — Tyler Hardman
(74) *Attorney, Agent, or Firm* — Alleman Hall McCoy Russell & Tuttle LLP

(57) ABSTRACT

A toner conveying device includes a first communication opening, a toner supply opening, a toner conveyance passage, an opening/closing member, and a moving member. The first communication opening communicates with a toner discharge outlet formed in a toner case in a state where the toner case is attached to a predetermined attachment position, the toner case including an operation portion. The toner conveyance passage connects the first communication opening to the toner supply opening. The opening/closing member moves between a closing position and an opening position. When the opening/closing member is at the closing position, the toner supply opening is closed, and when the opening/closing member is at the opening position, the toner supply opening is opened. The moving member is dislocated in conjunction with an operation of the operation portion in such a way as to move the opening/closing member from the closing position to the opening position.

11 Claims, 13 Drawing Sheets

(56) References Cited

U.S. PATENT DOCUMENTS

| | | | | |
|---|---|---|---|---|
| 2010/0054819 | A1 | 3/2010 | Sato | |
| 2010/0111563 | A1 | 5/2010 | Sato | |
| 2011/0064474 | A1* | 3/2011 | Funada | 399/258 |
| 2011/0081164 | A1 | 4/2011 | Sato | |
| 2012/0163862 | A1 | 6/2012 | Sato | |
| 2012/0251167 | A1* | 10/2012 | Matsumoto | 399/111 |
| 2013/0089360 | A1 | 4/2013 | Sato | |
| 2014/0050505 | A1 | 2/2014 | Sato | |
| 2014/0348541 | A1 | 11/2014 | Sato | |
| 2015/0043945 | A1* | 2/2015 | Kitagawa | 399/258 |

* cited by examiner

TONER CONVEYING DEVICE AND IMAGE FORMING APPARATUS INCLUDING THE SAME

INCORPORATION BY REFERENCE

This application is based upon and claims the benefit of priority from the corresponding Japanese Patent Application No. 2014-024474 filed on Feb. 12, 2014, the entire contents of which are incorporated herein by reference.

BACKGROUND

The present disclosure relates to a toner conveying device for conveying, to a developing device, toner supplied from a toner case, and to an image forming apparatus including the toner conveying device, and specifically to a mechanism for opening and closing a toner supply opening through which the toner is supplied to the developing device.

A developing device is installed in an image forming apparatus which is a copier, a printer or the like that forms an image on a print sheet based on the electrophotography. Inside the developing device, developer including toner is stored. The developing device develops, with the toner included in the developer, an electrostatic latent image that has been formed on an image carrier such as a photoconductor drum. As developing is performed by the developing device, the toner inside the developing device is reduced. As a result, a toner case storing the toner is attached to the image forming apparatus such that the toner is supplied from the toner case to the developing device. Conventionally, the image forming apparatus is provided with a toner supply opening and an opening/closing member (shutter member), wherein the toner supply opening is used to supply the toner to the developing device, and the opening/closing member opens and closes the toner supply opening. The opening/closing member is coupled with an operation portion, such as an operation lever, provided on the toner case such that the user operates the operation portion to open and close the toner supply opening.

Meanwhile, when the toner case is attached to the image forming apparatus and an attempt is made to supply the toner in the state where the toner supply opening is closed by the opening/closing member, a toner supply passage connecting a toner discharge outlet of the toner case to the toner supply opening may be clogged with the toner and the toner may be aggregated. When the toner is aggregated, the opening/closing member may not be operated or may be broken. In addition, the aggregation of the toner may deteriorate the developability and decrease the image quality. As a result, in a conventional image forming apparatus, the operation portion is provided in an attachment portion to which the toner case is to be attached, and the operation portion is configured to interfere with a toner case when an attempt is made to attach the toner case in the state where the toner supply opening is closed, to prevent the toner case from being attached to the attachment portion in that state.

SUMMARY

A toner conveying device according to an aspect of the present disclosure is for conveying toner in a toner case to a developing device and includes a first communication opening, a toner supply opening, a toner conveyance passage, an opening/closing member, and a moving member. The first communication opening is configured to communicate with a toner discharge outlet formed in a toner case in a state where the toner case is attached to a predetermined attachment position, the toner case including an operation portion. The toner supply opening is for which toner to be supplied to the developing device. The toner conveyance passage connects the first communication opening to the toner supply opening. The opening/closing member is configured to move between a closing position and an opening position such that when the opening/closing member is at the closing position, the toner supply opening is closed, and when the opening/closing member is at the opening position, the toner supply opening is opened. The moving member is configured to be dislocated in conjunction with an operation of the operation portion in such a way as to move the opening/closing member from the closing position to the opening position.

An image forming apparatus according to another aspect of the present disclosure includes the toner conveying device, an attachment portion, and the developing device. The attachment portion is configured to attach the toner case to the attachment position. The developing device is configured to develop a toner image on an image carrier by using toner conveyed by the toner conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
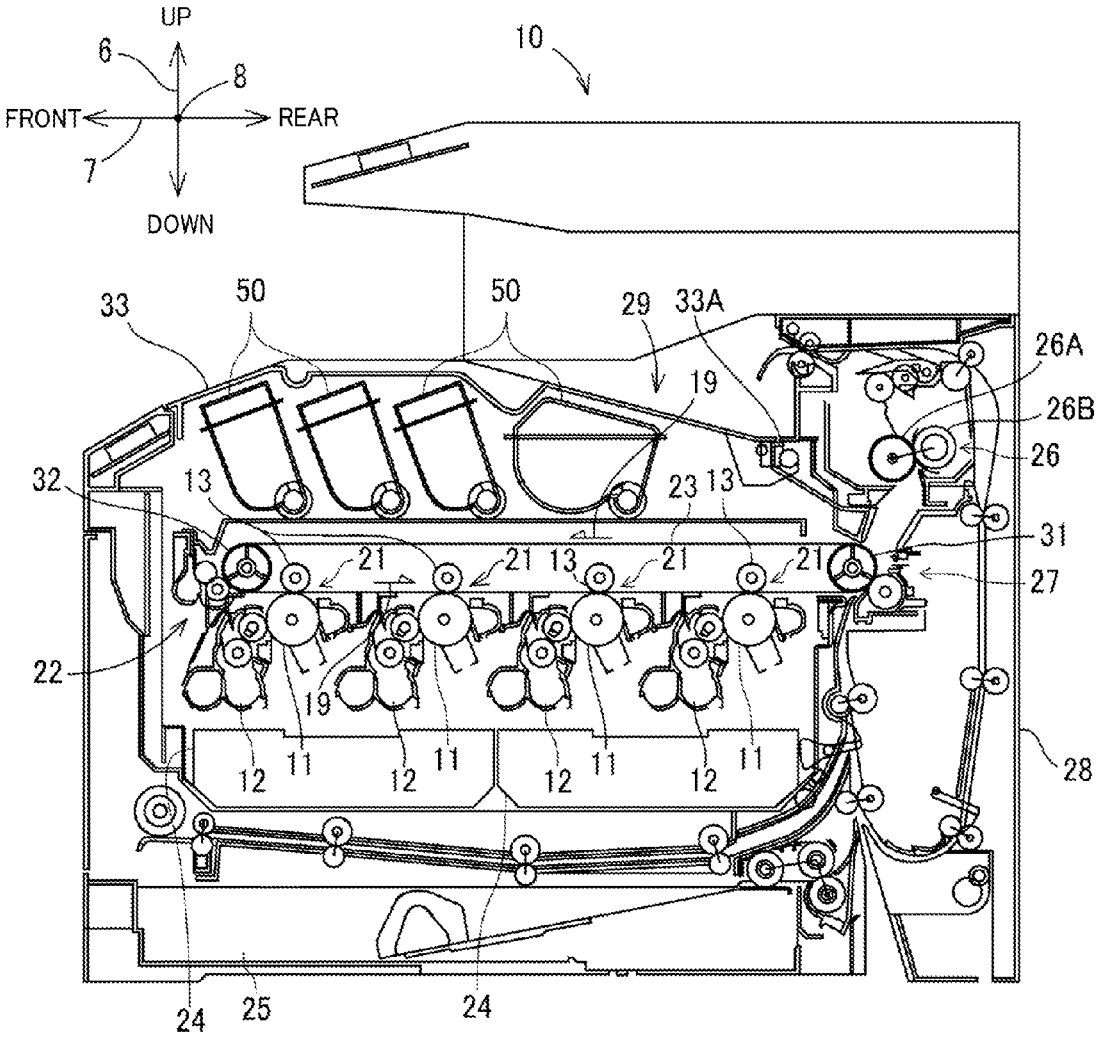
FIG. 1 is a diagram showing the configuration of an image forming apparatus according to an embodiment of the present disclosure.

The following describes an embodiment of the present disclosure with reference to the attached drawings. It should be noted that the following description is an example of a specific embodiment of the present disclosure and should not limit the technical scope of the present disclosure. It is noted that for the sake of explanation, an up-down direction 6 is defined based on the state (the state shown in FIG. 1) where an image forming apparatus 10 in an embodiment of the present disclosure is installed on a flat surface. In addition, a front-rear direction 7 is defined on the supposition that the left side on the plane of FIG. 1 is the front side (front-surface side) of the image forming apparatus 10. Furthermore, a left-right direction 8 (a direction perpendicular to the plane of FIG. 1) is defined based on the image forming apparatus 10 of FIG. 1 viewed from the front side. That is, the front side on the plane of FIG. 1 is the right side of the image forming apparatus 10, and the depth side on the plane of FIG. 1 is the left side of the image forming apparatus 10.

[Image Forming Apparatus 10]

The image forming apparatus 10 is an apparatus that includes at least a print function. As shown in FIG. 1, the image forming apparatus 10 is a so-called tandem color printer. The image forming apparatus 10 prints an image on a sheet of print paper by using a developer that contains toner. It is noted that the image forming apparatus 10 may be any apparatus as far as it has the print function. For example, the image forming apparatus 10 may be a multifunction peripheral having a plurality of functions including the print function, or an image forming apparatus such as a FAX apparatus or a copier. Of course, the image forming apparatus 10 may be an apparatus that forms a monochrome image, instead of an apparatus that forms a color image.

As shown in FIG. 1, the image forming apparatus 10 includes, as major components, four image forming portions 21, an intermediate transfer unit 22 (an example of the transfer portion and the toner conveying device of the present disclosure), a sheet feed device 25, a fixing device 26, a secondary transfer device 27, an exposure device 24, and four toner containers 50 (50A-50D). These components are attached to an apparatus main body 28 that is a housing constituting an external frame (not shown), an internal frame (not shown) and the like of the image forming apparatus 10. It is noted that the toner containers 50 are an example of the toner case for the image forming apparatus 10.

The four image forming portions 21 are disposed, in the apparatus main body 28, below the intermediate transfer unit 22. The image forming portions 21 are aligned along the front-rear direction 7. The image forming portions 21 are electrophotographic image forming portions that form toner images respectively on the photoconductor drums 11, and transfer the toner images to a transfer belt 23 provided in the intermediate transfer unit 22 by overlaying the respective toner images on the transfer belt 23 in sequence. The transfer belt 23 moves in a direction indicated by the arrow 19, and on the transfer belt 23 moving in that way, the toner images are transferred in sequence. In the example shown in FIG. 1, in order from the downstream side in the movement direction of the transfer belt 23 (the direction indicated by the arrow 19), the image forming portions 21 for black, yellow, cyan, and magenta are disposed in a row in the apparatus main body 28.

The image forming portions 21 execute an image forming process of forming an image on a print sheet based on the so-called electrophotography. The image forming portions 21 print an image on a print sheet based on the image data input from outside via a network communication portion (not shown). Each of the image forming portions 21 includes a photoconductor drum 11 (an example of the image carrier of the present disclosure), a charging device (not shown), a developing device 12, a primary transfer device 13, and the like. The photoconductor drum 11 carries a toner image on its surface. The charging device charges the surface of the corresponding photoconductor drum 11 to a certain potential. The exposure device 24 scans the charged photoconductor drum 11 with laser light based on the image data. This allows an electrostatic latent image to be written on the surface of the photoconductor drum 11. The developing device 12 develops a toner image on the photoconductor drum 11. Specifically, the developing device 12 forms a toner image on the surface of the photoconductor drum 11 as a visual image by adhering toner to the electrostatic latent image on the photoconductor drum 11 and developing the electrostatic latent image with the toner. The primary transfer device 13 transfers the toner image from the rotating photoconductor drum 11 to the transfer belt 23. It is noted that although not shown in FIG. 1, each image forming portion 21 includes a cleaning device that removes the toner image that has remained on the photoconductor drum 11.

The intermediate transfer unit 22 is disposed above the image forming portions 21. A driving pulley 31 and a driven pulley 32 are provided at opposite ends of the intermediate transfer unit 22 in the front-rear direction 7. The transfer belt 23 is suspended between and supported by the driving pulley 31 and the driven pulley 32. This allows a belt surface to extend horizontally in the front-rear direction 7. In addition, with the configuration where the transfer belt 23 is supported by the driving pulley 31 and the driven pulley 32, the transfer belt 23 can be rotationally moved in the direction indicated by the arrow 19. The transfer belt 23 is a belt having a shape of an endless loop and is made of rubber, urethane or other material.

The driving pulley 31 is disposed at a rear position (a right position in FIG. 1) close to the fixing device 26, and the driven pulley 32 is disposed at a front position (a left position in FIG. 1) away from the fixing device 26. Supported by the driving pulley 31 and the driven pulley 32, the transfer belt 23 can move (run) while its surface is in contact with the surfaces of the photoconductor drums 11. When the transfer belt 23 passes through between the photoconductor drums 11 and the primary transfer devices 13, the toner images are transferred in sequence from the photoconductor drums 11 onto the surface of the transfer belt 23 and overlaid with each other. It is noted that a detailed explanation of the configuration of the intermediate transfer unit 22 is provided below.

The secondary transfer device 27 is disposed in the rear of the apparatus main body 28. The secondary transfer device 27 transfers the toner images of the plurality of colors transferred on the transfer belt 23 to a print sheet conveyed from a sheet feed tray of the sheet feed device 25. The print sheet with the color toner image transferred thereon is conveyed to the fixing device 26. The fixing device 26 fixes the color toner image on the print sheet, to the print sheet by heat. The fixing device 26 includes a heating roller 26A and a pressure roller 26B. The heating roller 26A is heated to a high temperature. The pressure roller 26B is disposed to face the heating roller 26A. In the fixing device 26, the print sheet is conveyed while being nipped by a predetermined biasing force at a nip portion between the heating roller 26A and the pressure roller 26B. This allows the color toner image to be fused and adhered to the print sheet. Subsequently, the print sheet is discharged onto a sheet discharge tray 29 provided on an upper part of the apparatus main body 28.

As described above, the image forming apparatus 10 forms a color toner image on the surface of the transfer belt 23 by causing the plurality of image forming portions 21 to transfer toner images of different colors onto the transfer belt 23 while the belt is running so that the toner images are overlaid with each other. The secondary transfer device 27 transfers the color toner image from the transfer belt 23 to a print sheet. This allows a color image to be formed on the print sheet. It is noted that, as another embodiment, the transfer belt 23 may be used as a conveyance belt, and the toner images may be overlaid directly on a print sheet that is conveyed on the conveyance belt. Also, as a still another embodiment, an intermediate transfer member shaped like a roller may be used in place of the transfer belt 23.

The four toner containers 50 (50A-50D) are disposed above the intermediate transfer unit 22. Inside the apparatus main body 28, the four toner containers 50 are aligned in a row along the transfer belt 23 in the front-rear direction 7. The toner containers 50 are configured to supply toner to developing devices 12 of corresponding colors.

Figure 2:
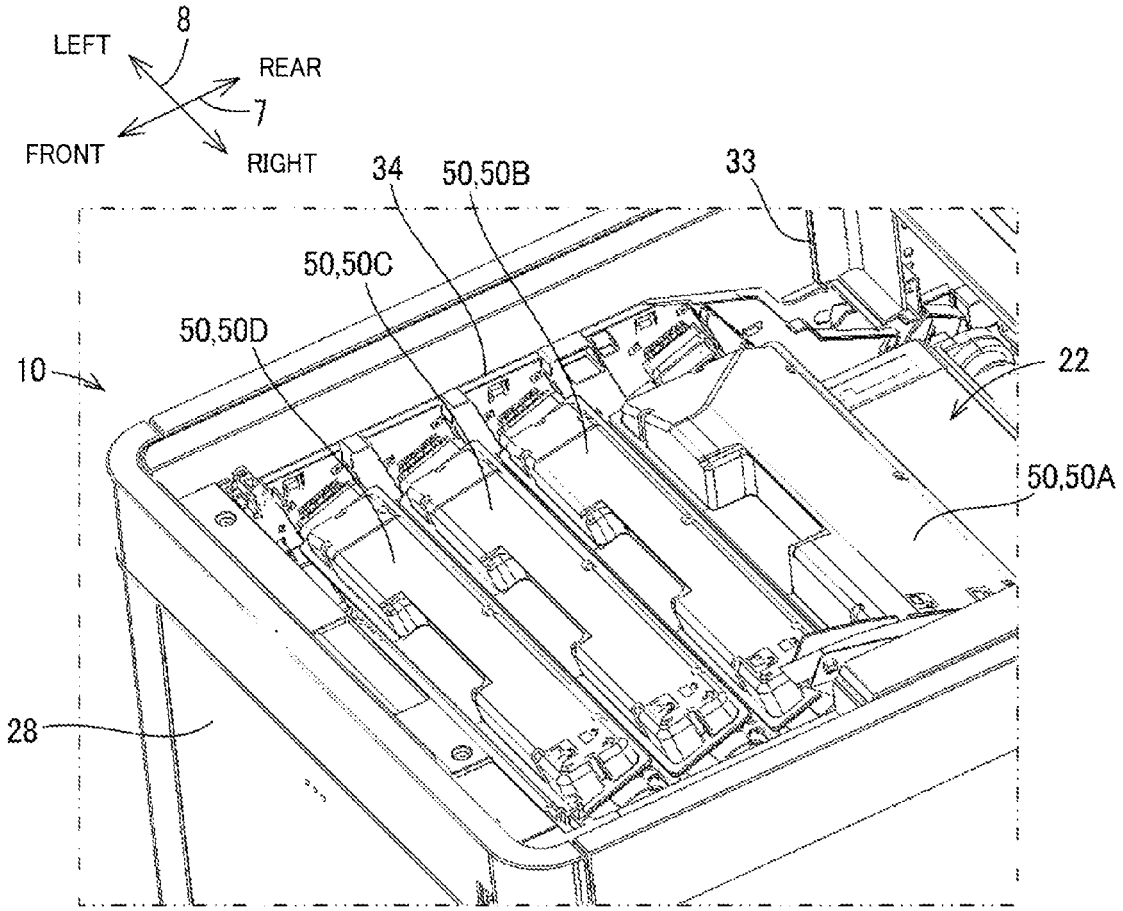
FIG. 2 is a perspective view showing the state where toner containers are attached to an intermediate transfer unit of the image forming apparatus.

As shown in FIG. 2, an attachment portion 34 to which the toner containers 50 are attached is provided in the apparatus main body 28. Specifically, the attachment portion 34 is provided above the intermediate transfer unit 22. A top cover 33 forming an upper part of the apparatus main body 28 is supported by the apparatus main body 28 so as to be opened and closed by being rotationally moved around a spindle 33A (see FIG. 1). The spindle 33A is provided in rear of the four toner containers 50. When the top cover 33 is rotationally moved upward (in the opening direction), the attachment portion 34, to which the toner containers 50 are attached, is exposed. The attachment portion 34 is integrally formed with the upper part of the intermediate transfer unit 22, and includes a plurality of storing portions for storing respective toner containers 50. When attached, the toner containers 50 are respectively stored in the storing portions. It is noted that the attachment portion 34 is not limited to the configuration where it is integrally formed with the upper part of the intermediate transfer unit 22, but may be attached to the apparatus main body 28 as an independent member separate from the intermediate transfer unit 22.

Figure 3:
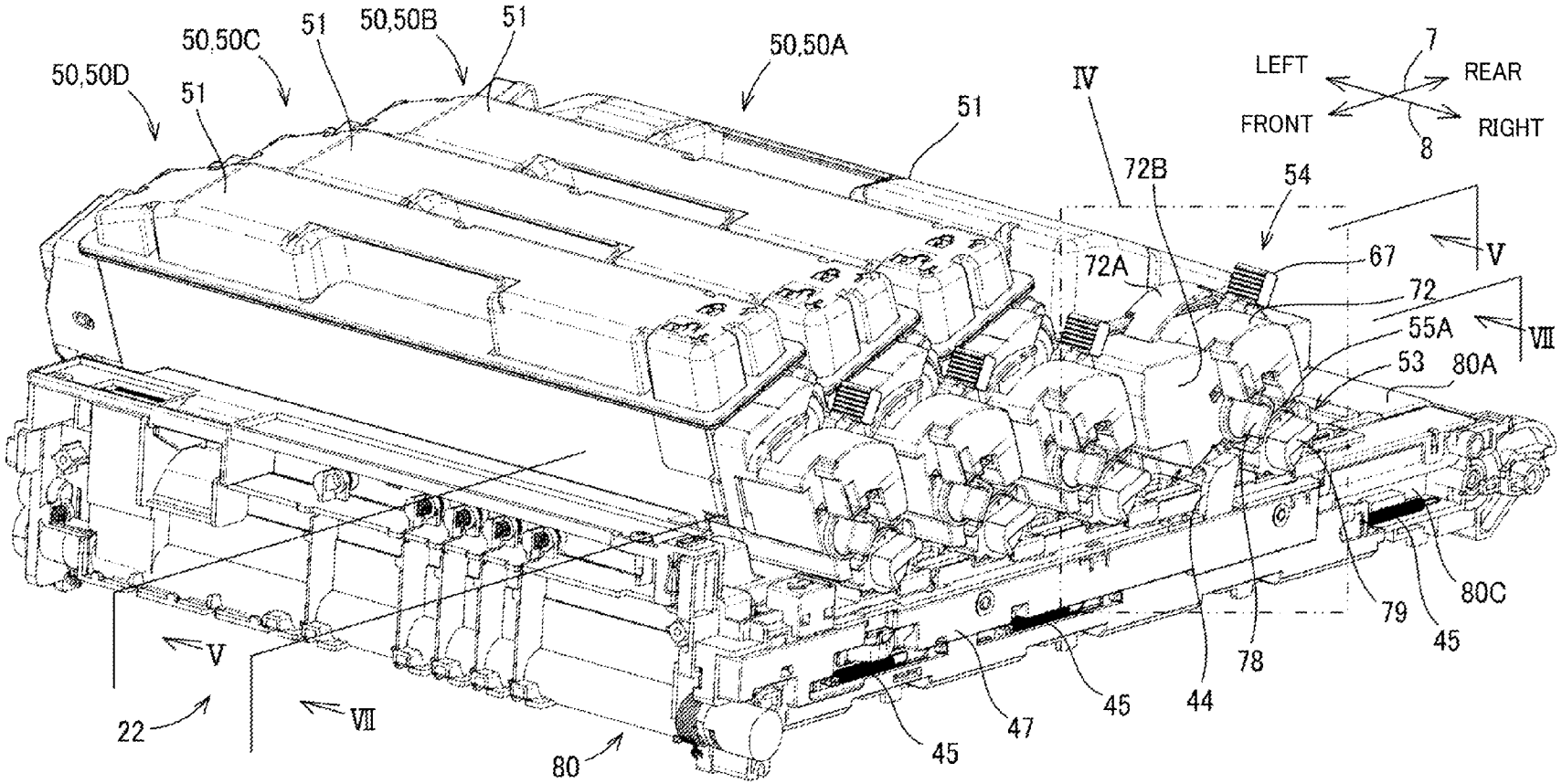
FIG. 3 is a perspective view showing the configuration of the toner containers and the intermediate transfer unit.

The toner containers 50 store toner of different colors that correspond to the colors of the image forming portions 21. Specifically, the toner containers 50 (50A-50D) store toner of black, yellow, cyan, and magenta, respectively. As shown in FIGS. 1 through 3, among the four toner containers 50, the toner container 50A positioned on the most rear side is a large-capacity type and can store larger amount of toner than the other toner containers 50B-50D. The toner container 50A stores black toner. The toner containers 50B-50D have the same shape and capacity. The toner container 50B stores yellow toner, the toner container 50C stores cyan toner, and the toner container 50D stores magenta toner. The toner container 50B is disposed in front of the toner container 50A, the toner container 50C is disposed in front of the toner container 50B, and the toner container 50D is disposed in front of the toner container 50C.

[Configuration of Toner Containers 50]

The following describes the configuration of the toner containers 50. It is noted here that the large-capacity-type toner container 50A and the other toner containers 50B-50D have the same configuration except for the size of the toner storing part. In addition, the toner containers 50B-50D have the same configuration except for the arrangement position. As a result, in the following description, the toner containers 50A-50D are described as a toner container 50.

Figure 4:
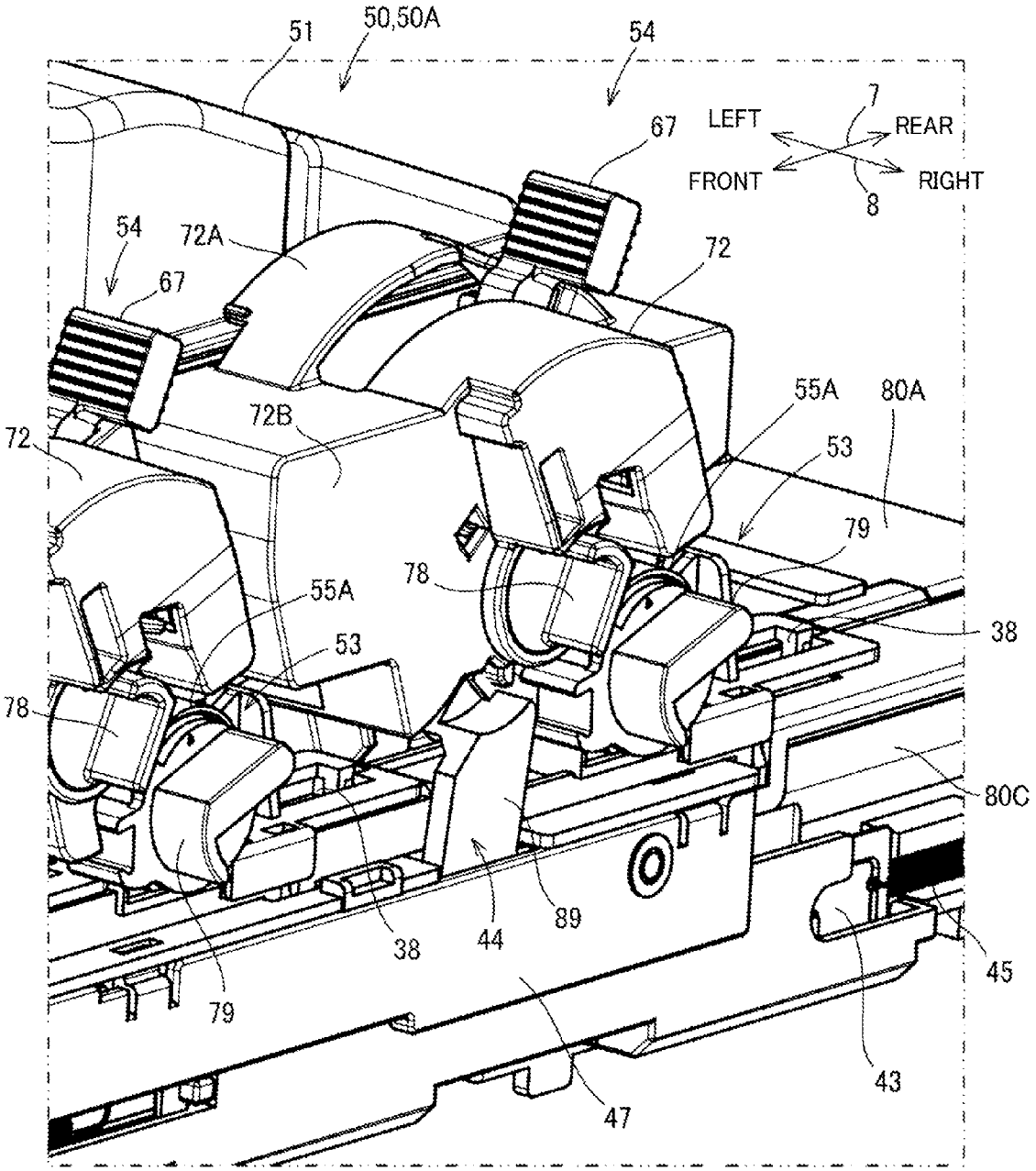
FIG. 4 is an expanded view of a main part IV shown in FIG. 3.
Figure 5:
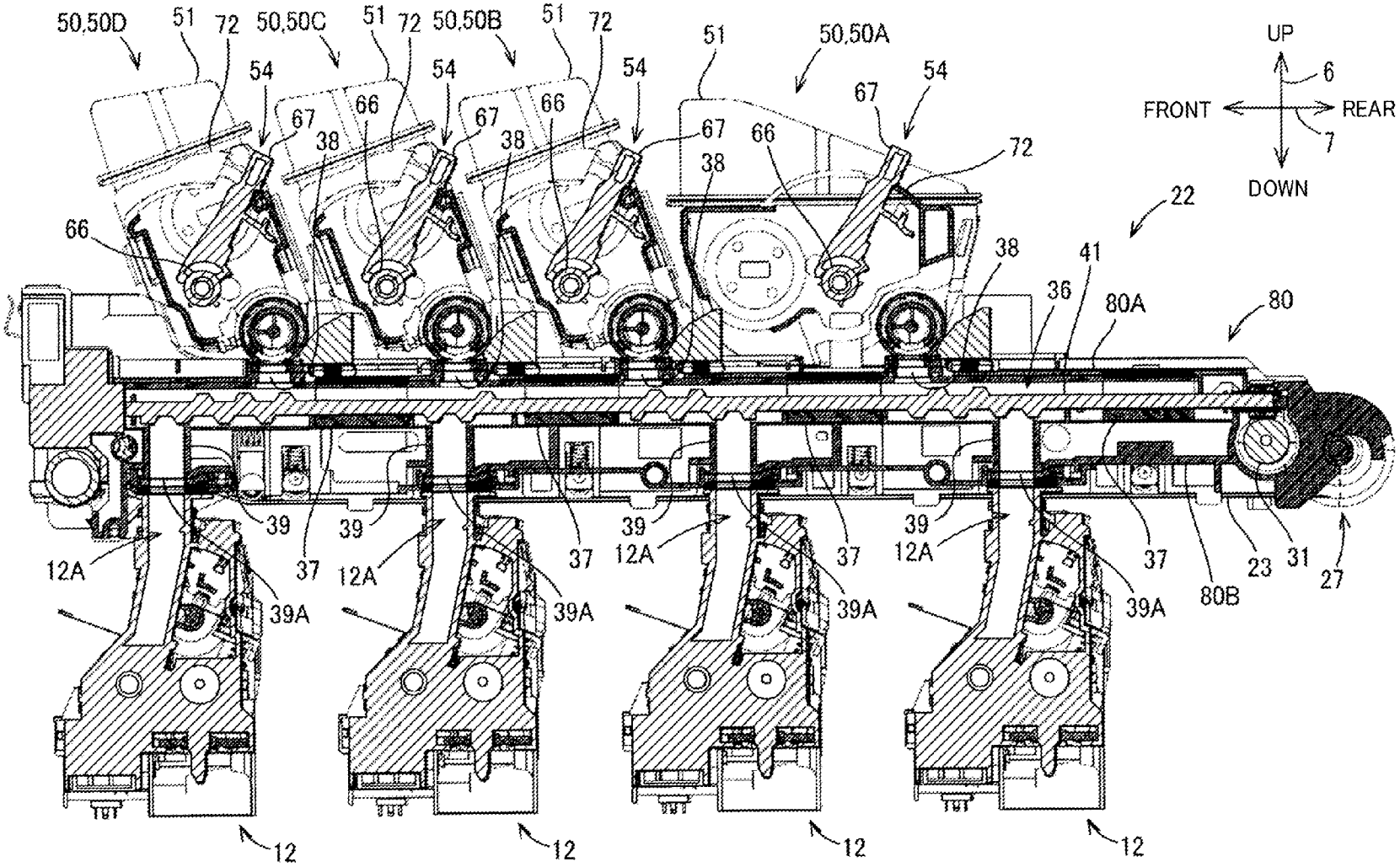
FIG. 5 is a cross section taken along a plane V-V of FIG. 3.

The toner container 50 stores toner that is to be supplied to the developing device 12. As shown in FIGS. 3 and 4, the toner container 50 includes a housing 51, a toner discharge outlet 52 (see FIGS. 5 and 6), an opening/closing mechanism 53, and an operation portion 54. The toner is stored inside the housing 51. As shown in FIG. 5, the toner discharge outlet 52 is formed in the housing 51. The toner discharge outlet 52 is formed in the bottom of the housing 51 at the right end thereof. In addition, as shown in FIG. 4, the operation portion 54 is provided on the housing 51 so that it can be operated by the user.

The housing 51 is made of a resin material, and as shown in FIG. 3, is formed in the shape of a box elongated in the left-right direction 8. That is, the longitudinal direction of the housing 51 matches the left-right direction 8 of the image forming apparatus 10 shown in FIG. 1. It is noted that in FIG. 3, the up-down direction 6, front-rear direction 7, and left-right direction 8 are defined in the state where the intermediate transfer unit 22 is attached to the apparatus main body 28. In the housing 51, a stirring paddle (not shown) for stirring the toner, a spiral shaft 58 (see FIG. 6) for conveying the toner stored inside to the toner discharge outlet 52 (see FIGS. 5 and 6), and the like are provided.

Figure 6:
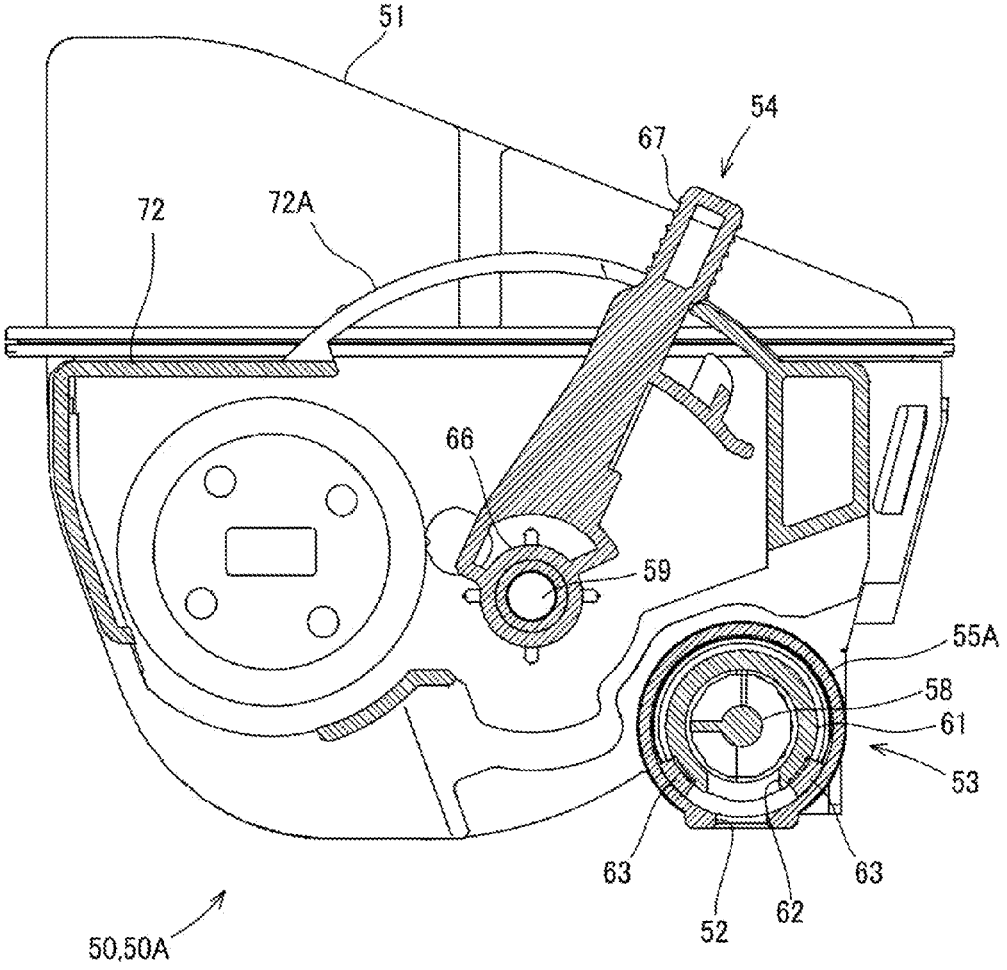
FIG. 6 is an expanded view of a cross section of the toner container shown in FIG. 5.

As shown in FIGS. 5 and 6, the toner discharge outlet 52 is a pass-through opening passing through the bottom wall of the housing 51 downward. Specifically, as shown in FIG. 6, a protruding portion 55A of an approximate shape of cylinder protruding and extending rightward is formed at the right end of the housing 51. The toner discharge outlet 52 is formed to pass through the circumferential wall of the protruding portion 55A downward. The toner discharge outlet 52 is opened and closed by the opening/closing mechanism 53.

As shown in FIG. 6, the opening/closing mechanism 53 includes a cylinder 61, an opening 62, a seal member 63, and a second coupling portion 79 (see FIG. 4). The cylinder 61 is formed in the shape of a cylinder, and is inserted into the protruding portion 55A provided at the right end of the housing 51. The right end of the cylinder 61 is closed. In addition, the second coupling portion 79 is integrally formed with the right end of the cylinder 61. The opening 62 is formed on a side surface (lower surface) of the cylinder 61. In addition, the seal member 63 is provided on an inner wall surface of the protruding portion 55A at a peripheral of the toner discharge outlet 52. The seal member 63 is provided to prevent toner scattering.

A bearing (not shown) is formed inside the cylinder 61 at the right end thereof. An end of the spiral shaft 58 is supported by the bearing so that the spiral shaft 58 can be rotated in the cylinder 61.

The cylinder 61 is attached so as to be rotatable with respect to the protruding portion 55A. When a rotational force is input to the second coupling portion 79, the cylinder 61 is rotated. When, as the cylinder 61 rotates, the opening 62 of the cylinder 61 overlaps with the toner discharge outlet 52, the toner discharge outlet 52 is opened as shown in FIG. 6. Hereinafter, the position of the cylinder 61 (the position shown in FIG. 6) that allows the toner discharge outlet 52 to be opened is referred to as a "first opening position". At the first opening position, toner in the housing 51 is discharged from the toner discharge outlet 52 to outside. On the other hand, when the cylinder 61 is rotated to a position where the circumferential wall of the cylinder 61 except for the opening 62 overlaps with the toner discharge outlet 52, the toner discharge outlet 52 is closed by the circumferential wall of the cylinder 61. Hereinafter, the position of the cylinder 61 where the toner discharge outlet 52 is closed is referred to as a "first closing position". In this way, with the rotation of the second coupling portion 79, the cylinder 61 can be dislocated between the first opening position where the toner discharge outlet 52 is opened and the first closing position where the toner discharge outlet 52 is closed. That is, the toner discharge outlet 52 is opened and closed as the cylinder 61 is rotated. When the toner container 50 is attached to the attachment portion 34, the second coupling portion 79 is coupled with a driving transmission mechanism (not shown) which is provided in the apparatus main body 28. This allows the second coupling portion 79 to receive the rotational force from the driving transmission mechanism. It is noted that the driving transmission mechanism is a well-known mechanism including a gear, a cam and the like, and description thereof is omitted in the present embodiment.

When the toner container 50 is attached to the attachment portion 34, the toner discharge outlet 52 is disposed at a position to face a first communication opening 38 that is described below and is brought into close contact with the first communication opening 38. The attachment position of the toner container 50 in the attachment portion 34 is determined such that the above-described positional relationship is satisfied. The operation portion 54 is used to open and close the toner discharge outlet 52 in the state where the toner container 50 is attached to the attachment portion 34. As shown in FIGS. 3 and 4, the operation portion 54 is provided at the right end of the housing 51. As shown in FIGS. 5 and 6, the operation portion 54 includes a shaft 66 and a lever 67. The shaft 66 is rotatably supported by the housing 51. The lever 67 is extended vertically from the shaft 66.

The shaft 66 is attached to a spindle 59 that protrudes rightward from the right end of the housing 51. The spindle 59 is inserted into a shaft hole formed at the center of the shaft 66. This allows the shaft 66 to pivot around the spindle 59, and allows the lever 67 to pivot integrally with the shaft 66 around the shaft core of the spindle 59. In the present embodiment, the operation portion 54 can be rotationally moved between a first attitude in which the lever 67 is tilted frontward (the attitude shown in FIG. 11) and a second attitude in which the lever 67 is tilted rearward (the attitude shown in FIGS. 4 and 5). Here, the first attitude is an attitude corresponding to the first closing position of the cylinder 61. Specifically, to maintain the cylinder 61 at the closing position, the lever 67 is operated to dispose the operation portion 54 at the first attitude. On the other hand, the second attitude is an attitude corresponding to the first opening position of the cylinder 61. Specifically, to rotate the cylinder 61 to dislocate it to the first opening position, the lever 67 is operated to dispose the operation portion 54 at the second attitude.

As shown in FIG. 4, a cover 72 is provided at the right end of the housing 51. The cover 72 is attached so as to cover the base part of the lever 67 and the like. A slit of a circular arc shape is formed in an upper wall 72A of the cover 72, and the upper end of the lever 67 projecting upward from the slit is exposed to outside. In addition, two openings are formed in a right-side wall 72B of the cover 72. From these openings, the second coupling portion 79 of the cylinder 61 and a first coupling portion 78 that is described below project rightward and are exposed to outside.

The operation portion 54 includes the first coupling portion 78 (see FIG. 4) that is rotated when the lever 67 is operated. The first coupling portion 78 is integrally formed with the right end of the shaft 66. As a result, when the lever 67 is rotationally operated, the first coupling portion 78 and the shaft 66 are rotationally moved in the same direction as the lever 67. The first coupling portion 78 is formed in the shape of a plate that projects rightward from the right end of the shaft 66. When the toner container 50 is attached to the attachment portion 34, the first coupling portion 78 is coupled with the driving transmission mechanism (not shown) provided in the apparatus main body 28. With this configuration, when the lever 67 of the operation portion 54 is operated, the operation driving force thereof is transmitted from the lever 67 to the driving transmission mechanism via the shaft 66 and the first coupling portion 78. As described above, the driving transmission mechanism is also coupled with the second coupling portion 79 of the cylinder 61. As a result, when the operation portion 54 is operated, the operation driving force thereof is input from the driving transmission mechanism to the second coupling portion 79. In the present embodiment, when the lever 67 is rotationally operated from the first attitude to the second attitude, the operation driving force thereof is transmitted to the second coupling portion 79 via the driving transmission mechanism. When the operation driving force is transmitted to the second coupling portion 79, the second coupling portion 79 causes the cylinder 61 to rotate from the first closing position to the first opening position. That is, when the lever 67 is at the first attitude, the cylinder 61 maintains the first closing position. At this time, the toner discharge outlet 52 is kept to be closed. On the other hand, when the lever 67 is rotationally operated from the second attitude to the first attitude, the cylinder 61 is rotated from the first closing position to the first opening position in conjunction with the rotational operation of the lever 67. This allows the toner discharge outlet 52 to be opened.

With the above-described configuration where the operation driving force (rotational driving force) of the lever 67 of the toner container 50 is transmitted to the opening/closing mechanism 53 via the driving transmission mechanism of the apparatus main body 28 side, even if the user erroneously operates the lever 67 before the housing 51 is attached to the apparatus main body 28, the operation driving force is not transmitted to the opening/closing mechanism 53, and the toner discharge outlet 52 is not opened. It is thus possible to prevent toner leakage from the housing 51.

The present embodiment describes an example case where the driving transmission mechanism is provided in the apparatus main body 28. However, the driving transmission mechanism may be provided in the toner container 50. For example, it is possible to adopt a configuration where the driving transmission mechanism is provided at the right end of the toner container 50 such that the operation driving force is transmitted between the first coupling portion 78 and the second coupling portion 79.

[Configuration of Intermediate Transfer Unit 22]

The following describes the configuration of the intermediate transfer unit 22. FIG. 5 is a cross section of the intermediate transfer unit 22 taken along a plane (plane V-V of FIG. 3) extending in the front-rear direction 7 and passing through the attachment position of the lever 67. In FIG. 5, the toner containers 50 and the developing devices 12 are also shown, as well as the intermediate transfer unit 22.

As shown in FIG. 3, the intermediate transfer unit 22 includes a unit main body 80 as a casing. The unit main body 80 is formed in the shape of a rectangular parallelepiped that is long in the front-rear direction 7 and the left-right direction 8 and is short in the up-down direction 6. The driving pulley 31 and the driven pulley 32 are rotatably provided at opposite ends of the unit main body 80 in the front-rear direction 7, and the transfer belt 23 is supported by these pulleys. The unit main body 80 includes an upper surface portion 80A (see FIG. 5) constituting the upper surface, a lower surface portion 80B (see FIG. 5) constituting the lower surface, a right side surface portion 80C (see FIG. 3) constituting the right side surface, and a left side surface portion (not shown) constituting the left side surface. The attachment portion 34 is provided on the upper portion, namely the upper surface portion 80A, of the unit main body 80.

As shown in FIG. 5, the intermediate transfer unit 22 includes a toner conveyance passage 36 for conveying the toner. The toner conveyance passage 36 is formed inside the unit main body 80. Specifically, the right end of the unit main body 80 protrudes more rightward than the transfer belt 23, and the toner conveyance passage 36 is formed inside the right end of the unit main body 80. The toner conveyance passage 36 is a passage in which the toner supplied from the toner containers 50 is conveyed to the developing device 12. In the present embodiment, the toner conveyance passage 36 is formed to connect a first communication opening 38 to an opening 39A of a toner supply portion 39, wherein these portions are described below. The toner conveyance passage 36 extends in the front-rear direction 7 in the unit main body 80. The toner conveyance passage 36 is partitioned into four passages respectively in correspondence with the four toner containers 50, and is partitioned by a partitioning member 37 such that the toners of the respective colors do not mix with each other in the toner conveyance passage 36. The toner conveying device of the present disclosure is realized by the toner conveyance passage 36, as well as the first communication opening 38, the opening 39A of the toner supply portion 39, and an opening/closing member 43 and a moving member 44 that are described below.

A spiral shaft 41 (an example of the conveyance member of the present disclosure) for conveying the toner in the toner conveyance passage 36 is provided in the toner conveyance passage 36. The spiral shaft 41 is composed of a spiral blade provided on a rotation shaft. As the spiral shaft 41 is rotated upon receiving a driving force, the spiral shaft 41 conveys the toner in one direction (right direction) in the toner conveyance passage 36. In the present embodiment, the spiral shaft 41 conveys, to the toner supply portions 39, the toner that has been supplied from the toner containers 50 via the first communication openings 38, wherein the first communication openings 38 and the toner supply portions 39 are described below. The toner supplied to the toner supply portions 39 drops downward, passes through the openings 39A, and enters the developing devices 12 via toner receiving inlets 12A.

Figure 8:
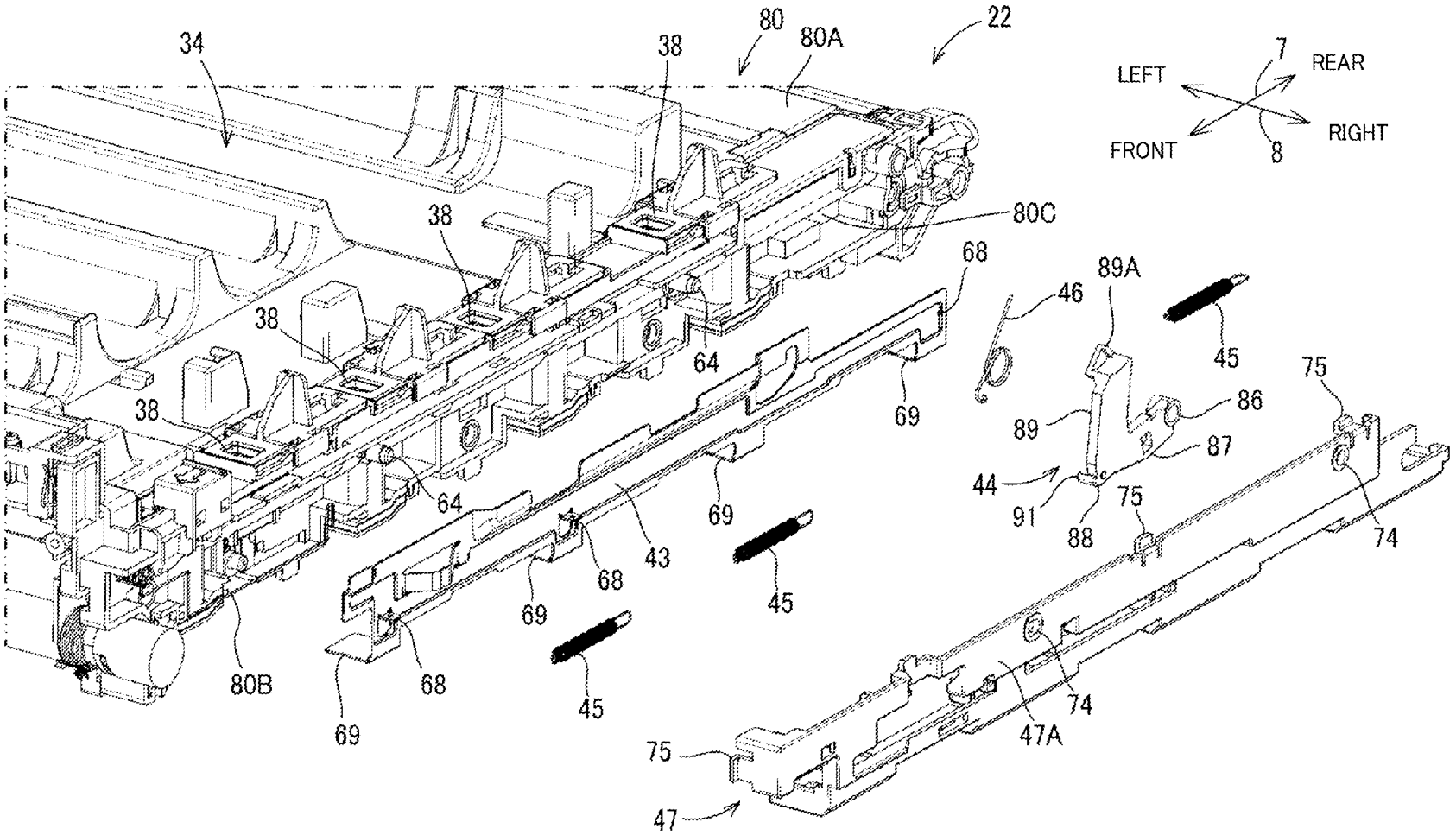
FIG. 8 is an exploded perspective view of a side part of the intermediate transfer unit.

As shown in FIGS. 5 and 8, a plurality of first communication openings 38 are provided at the right end of the upper surface portion 80A. Four first communication openings 38 provided in correspondence with the four toner containers 50. The first communication openings 38 are disposed in the upper surface portion 80A to be aligned on a straight line that extends along the front-rear direction 7. The first communication openings 38 pass through the upper surface portion 80A downward and communicate with the toner conveyance passage 36. In addition, each first communication opening 38 is positioned so as to communicate with the toner discharge outlet 52 formed in the corresponding toner container 50 in the state where the corresponding toner container 50 is attached to the attachment portion 34 (hereinafter, the state is also referred to as "container attachment state"). That is, in the container attachment state, the first communication opening 38 is provided below the toner discharge outlet 52. It is noted that, to prevent toner leakage at the peripheral of the toner discharge outlet 52, the first communication opening 38 is configured to to be in close contact with the toner discharge outlet 52 in the container attachment state.

Furthermore, a plurality of toner supply portions 39 are provided at the right end of the lower surface portion 80B. Four toner supply portions 39 are provided in correspondence with the four toner containers 50. The toner supply portions 39 are disposed in the lower surface portion 80B to be aligned on a straight line that extends along the front-rear direction 7. The toner supply portions 39 are formed in the shape of pipes extending in the up-down direction 6, and openings at the upper ends of the toner supply portions 39 are communicated with the toner conveyance passage 36. The openings 39A at the lower ends of the toner supply portions 39 are tonner supply openings for supplying toner to the developing devices 12. The openings 39A are communicated with the toner receiving inlets 12A of the developing devices 12. With this configuration, the toner conveyance passage 36 can convey the toner supplied from the first communication openings 38, to the openings 39A.

Figure 7:
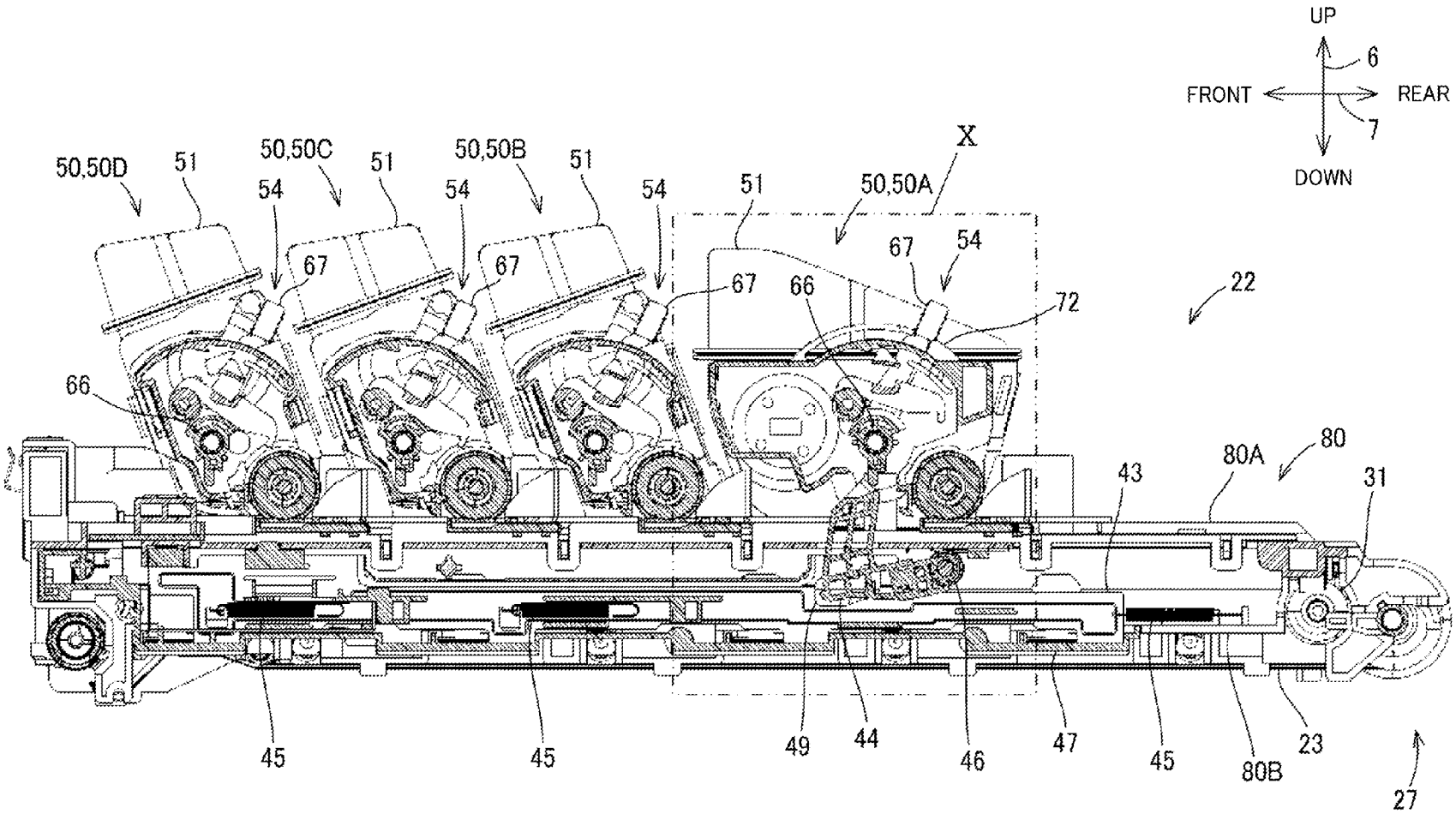
FIG. 7 is a cross section taken along a plane VII-VII of FIG. 3.
Figure 9:
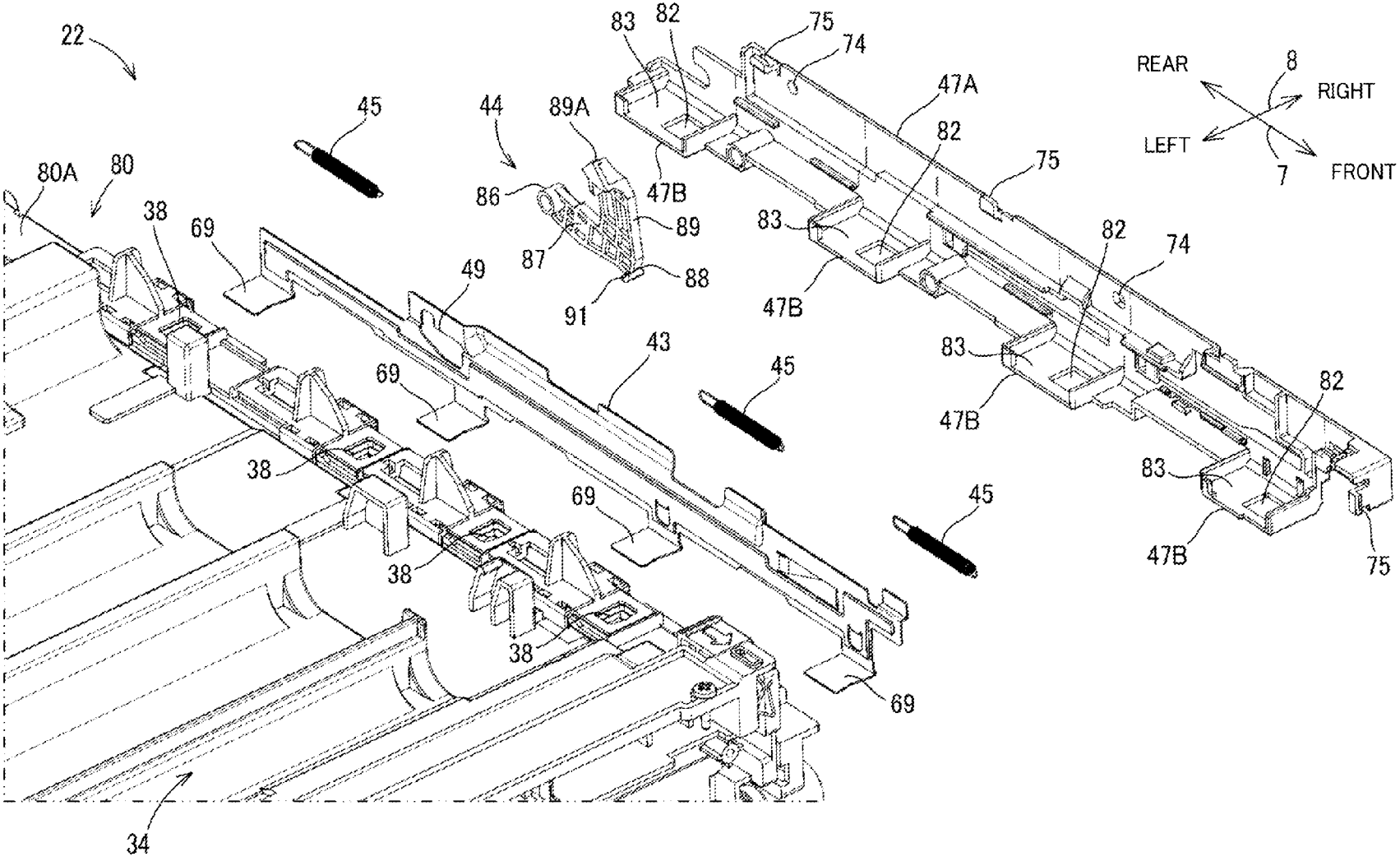
FIG. 9 is an exploded perspective view of a side part of the intermediate transfer unit.

As shown in FIGS. 7 through 9, the intermediate transfer unit 22 includes the opening/closing member 43, the moving member 44, three coil springs 45 (an example of the first elastic member of the present disclosure), a torsion coil spring 46 (an example of the second elastic member of the present disclosure), and a cover member 47. These component elements are attached to the right side surface portion 80C of the unit main body 80, thereby constituting the right side portion of the intermediate transfer unit 22. Here, FIG. 7 is a cross section of the intermediate transfer unit 22 taken along a plane (plane VII-VII of FIG. 3) extending in the front-rear direction 7 and passing through the protruding portion 55A of the toner container 50.

The opening/closing member 43 is a plate member that is long in the front-rear direction 7 and is formed by the resin molding or the plate metal. The opening/closing member 43 is used to open and close the openings 39A of the toner supply portions 39 that correspond to the plurality of colors, and is attached to the right side surface portion 80C so as to be movable in the front-rear direction 7 with respect to the right side surface portion 80C. The opening/closing member 43 is provided between the cover member 47 and the right side surface portion 80C in the state where the cover member 47 is fixed to the right side surface portion 80C. The opening/closing member 43 is supported by the cover member 47 so as to be movable in the front-rear direction 7. It is noted that the support mechanism of the opening/closing member 43 is described below.

In the present embodiment, the opening/closing member 43 is supported so as to be movable between: a second closing position (an example of the closing position of the present disclosure) for closing the opening 39A; and a second opening position (an example of the opening position of the present disclosure) for opening the opening 39A. As the opening/closing member 43 moves between the second closing position and the second opening position, the opening 39A is closed and opened. It is noted that the opening/closing operation of the opening 39A is described below.

As shown in FIG. 8, fixing portions 68 are provided on an outer side surface (the right surface) of the opening/closing member 43, wherein an end of each coil spring 45 is to be fixed to each fixing portion 68. The two fixing portions 68 on the front side are parts of the opening/closing member 43 that have been cut and bent outside. The fixing portion 68 on the rear side is a locking hole formed at the rear end of the opening/closing member 43. As shown in FIG. 7, the front end of the coil spring 45 is fixed to the fixing portion 68 of the opening/closing member 43 in the state where the longitudinal direction of the coil spring 45 approximately matches the front-rear direction 7. On the other hand, the rear end of the coil spring 45 is fixed to the cover member 47 or the right side surface portion 80C. Specifically, the rear ends of the two coil springs 45 on the front side are fixed to the cover member 47, and the rear end of the coil spring 45 on the rear side is fixed to the right side surface portion 80C. The coil springs 45 are so-called tension springs. Since the opening/closing member 43 is supported so as to be movable in the front-rear direction 7, if no external force is applied except for the spring force of the coil springs 45, the opening/closing member 43 is pulled rearward by receiving a rearward elastic biasing force from the coil springs 45. That is, the coil springs 45 elastically bias the opening/closing member 43 toward the rear side.

As shown in FIG. 3, the cover member 47 is attached to the right side surface portion 80C in the state where it covers the right side of the opening/closing member 43. As shown in FIG. 9, the cover member 47 includes a vertical portion 47A and four support portions 47B. The cover member 47 is plate-like and faces the right side surface portion 80C. The support portions 47B are plate-like and extend horizontally from the lower end of the vertical portion 47A. The cover member 47 is a plate member that is long in the front-rear direction 7, and is formed by, for example, the resin molding or the plate metal. Two locking holes 74 are formed in the vertical portion 47A. Two locking projections 64 projecting rightward are provided in the right side surface portion 80C (see FIG. 8), and the locking projections 64 are inserted into the locking holes 74 such that the cover member 47 is fixed to the right side surface portion 80C. It is noted that a locking piece 75 in the shape of a hook is provided on the cover member 47 at an appropriate position, and the locking piece 75 is locked to a locking groove of the right side surface portion 80C, thereby the cover member 47 is reliably fixed to the right side surface portion 80C.

A second communication opening 82 is formed in each of the four support portions 47B. That is, four second communication openings 82 are formed in the cover member 47. The four second communication openings 82 respectively correspond to the four toner supply portions 39 and toner receiving inlets 12A. Each of the support portions 47B is disposed between the opening 39A of the toner supply portion 39 and the toner receiving inlet 12A of the developing device 12 in the state where the cover member 47 is fixed to the right side surface portion 80C. Each second communication opening 82 is formed at a position corresponding to the opening 39A and the toner receiving inlet 12A. That is, each second communication opening 82 is disposed below the opening 39A and above the toner receiving inlet 12A in the state where the cover member 47 is fixed. As a result, the second communication openings 82 are communicated with the toner receiving inlets 12A of the developing devices 12. In the present embodiment, the opening 39A, second communication opening 82, and toner receiving inlet 12A are disposed proximate to each other in the up-down direction 6, to prevent leakage of toner at the peripheral of the opening 39A.

The opening/closing member 43 includes four lids 69 for covering and closing the second communication openings 82 that are formed in the cover member 47. The lids 69 are plate-like, extending horizontally from the lower end of the opening/closing member 43, and are arranged at predetermined interval along the longitudinal direction of the opening/closing member 43. The lids 69 are slidably supported on the upper surfaces (support surfaces) of the support portions 47B of the cover member 47. On each support portion 47B, the lid 69 is supported by a peripheral part of the second communication opening 82 and a flat surface 83 that is positioned more in rear of the second communication opening 82. With the configuration where the lids 69 are slidably supported on the upper surfaces of the support portions 47B, the opening/closing member 43 is supported between the right side surface portion 80C and the cover member 47 so as to be slidable in the front-rear direction 7. When the opening/closing member 43 is moved and the lids are disposed on the second communication openings 82, the second communication openings 82 are closed, thereby the openings 39A and toner receiving inlets 12A are closed. As understood from this, the position of the opening/closing member 43 when the lids 69 are disposed on the second communication openings 82 is the second closing position. In addition, when the opening/closing member 43 is moved and the lids 69 are disposed on the flat surface 83, the second communication openings 82 are opened, thereby the openings 39A through the toner receiving inlets 12A are communicated with each other as passages. That is, the openings 39A are opened. As understood from this, the position of the opening/closing member 43 when the lids 69 are disposed on the flat surface 83 is the second opening position. In other words, when the opening/closing member 43 is moved to the second closing position, the lids 69 cover the second communication openings 82, and when the opening/closing member 43 is moved to the second opening position, the lids 69 recede from the second communication openings 82 to the flat surface 83 side such that the second communication openings 82 are opened.

In the present embodiment, as described above, the opening/closing member 43 is pulled toward the rear side by the coil springs 45. That is, the coil springs 45 elastically bias the opening/closing member 43 toward the second opening position. As a result, when no external force is applied to the opening/closing member 43, the opening/closing member 43 maintains the state where it is disposed at the second opening position.

Figure 10:
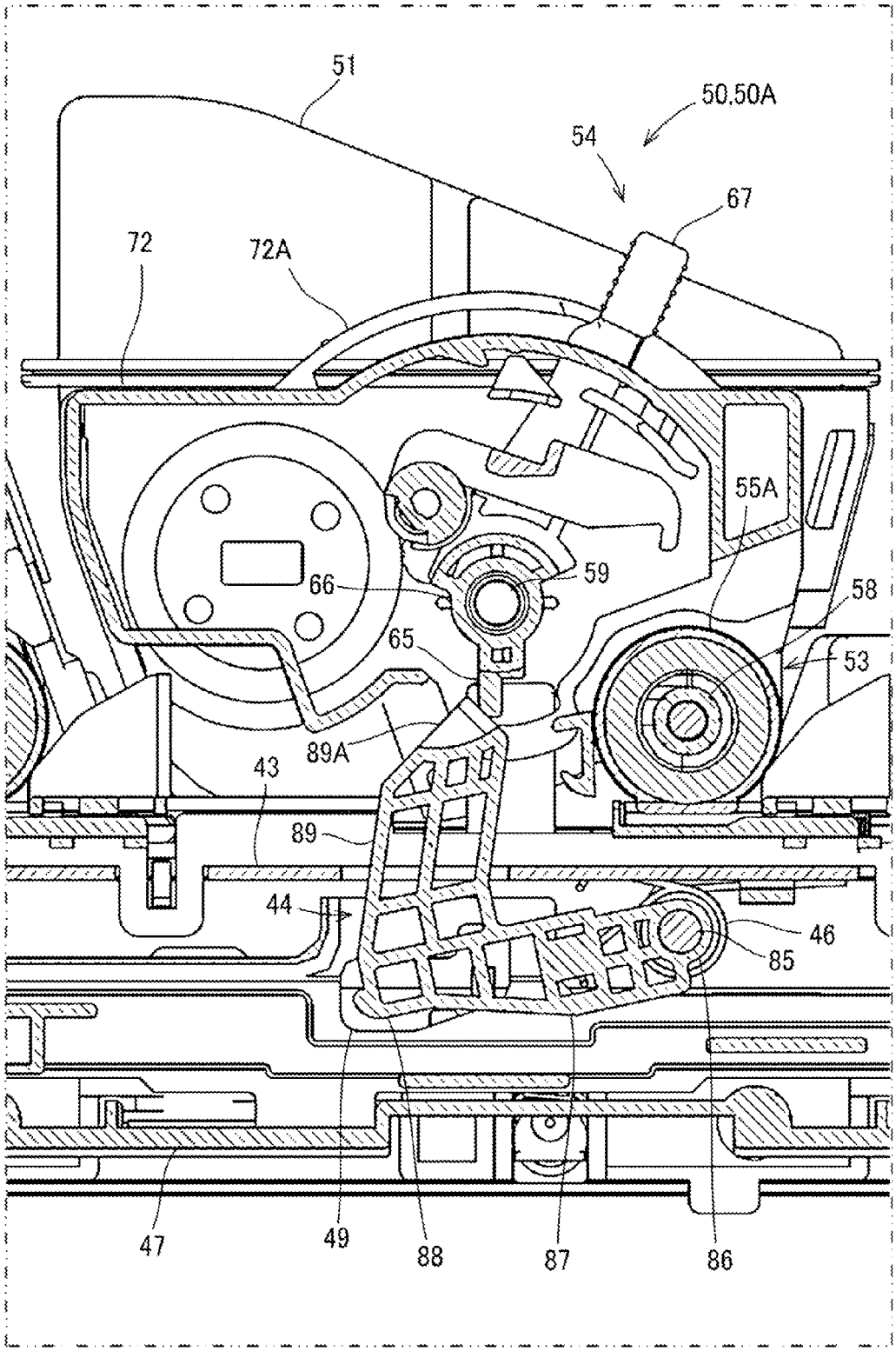
FIG. 10 is an expanded view of a main part X shown in FIG. 7.

As shown in FIG. 10, the moving member 44 is attached to the right side surface portion 80C. A spindle 85 protruding rightward is provided on the right side surface portion 80C, and the moving member 44 is pivotably supported by the spindle 85. In the present embodiment, the moving member 44 is configured to pivot around the spindle 85 between a first pivoting position and a second pivoting position that are described below. On the right side surface portion 80C, the spindle 85 is provided below the toner container 50A, specifically, below the protruding portion 55A of the toner container 50A. The moving member 44 is formed in the shape of a reversed L, and at an end thereof, a bearing 86 is provided. The bearing 86 is supported by the spindle 85. This enables the moving member 44 to pivot around the spindle 85.

The torsion coil spring 46 is attached to the spindle 85. One hook (foot) of the torsion coil spring 46 is engaged with the right side surface portion 80C, and the other hook (foot) of the torsion coil spring 46 is engaged with the moving member 44. The torsion coil spring 46 biases the moving member 44 such that the second arm 89 of the moving member 44 is dislocated upward. In the present embodiment, the torsion coil spring 46 elastically biases the moving member 44 such that the moving member 44 pivots clockwise in FIG. 10.

The moving member 44 is configured to be dislocated in conjunction with the movement of the operation portion 54 of the toner container 50A. Specifically, the moving member 44 includes: a first arm 87 that extends frontward from the bearing 86; a bending portion 88; and a second arm 89 that extends upward from the bending portion 88. The tip (upper end) of the second arm 89 reaches a projection 65 that projects downward from the shaft 66 of the operation portion 54. Furthermore, at the tip of the second arm 89, an abutting portion 89A configured to abut on the projection 65 is provided.

Figure 11:
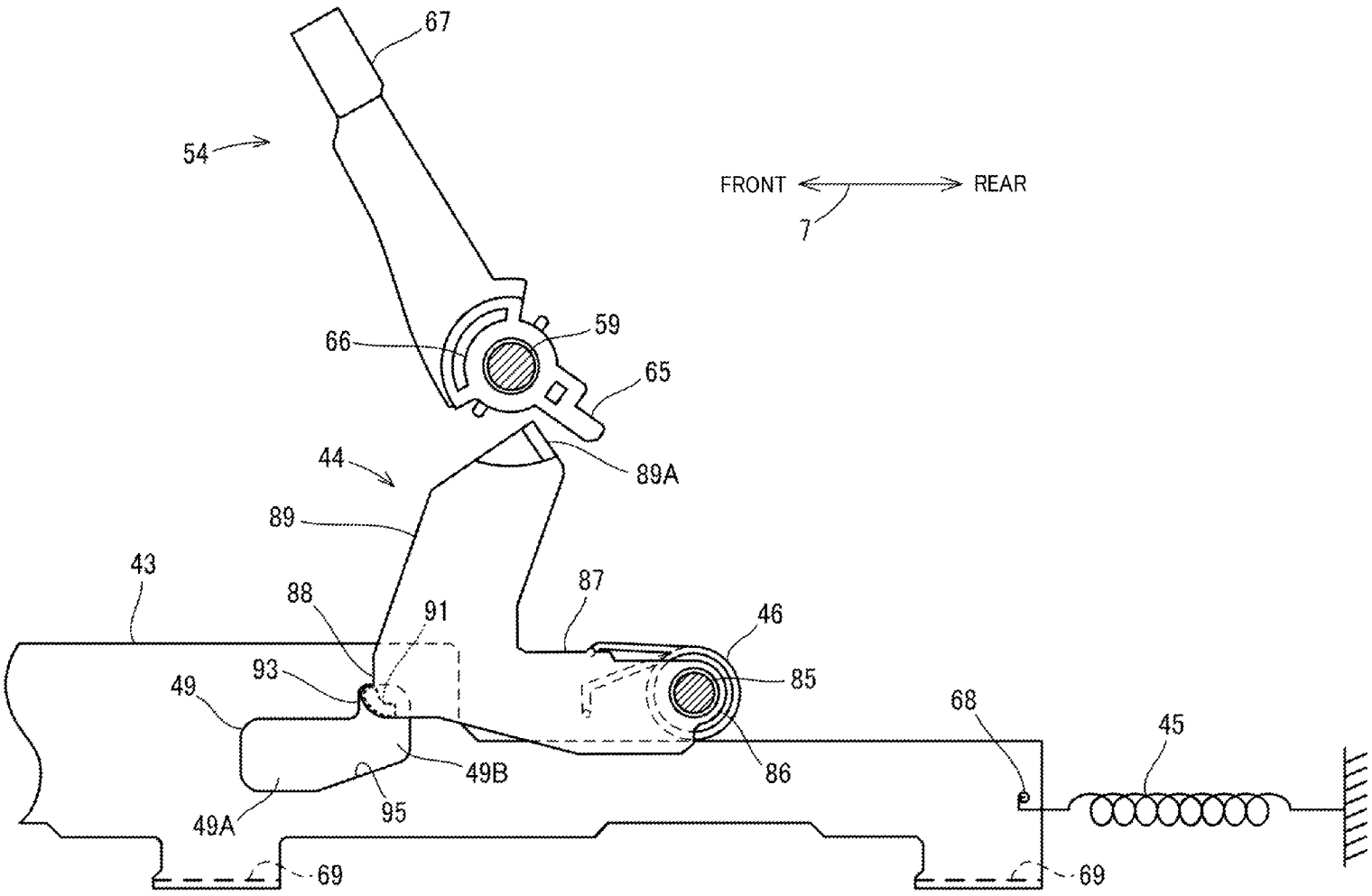
FIG. 11 is a schematic diagram for explaining the positional relationship among an operation portion, a moving member and an opening/closing member, and an opening/closing operation of the opening/closing member.

As shown in FIG. 11, when the lever 67 is disposed at the first closing position, the projection 65 is positioned away from the abutting portion 89A toward the rear side, and does not abut on the abutting portion 89A. Thus the moving member 44 does not receive a downward force from the projection 65. In that case, if the rotational movement of the moving member 44 is not restricted by an opening portion 49 that is described below, the moving member 44 is rotationally moved upward by the biasing force of the torsion coil spring 46 and is disposed at the first pivoting position (the position shown in FIG. 11).

Figure 13:
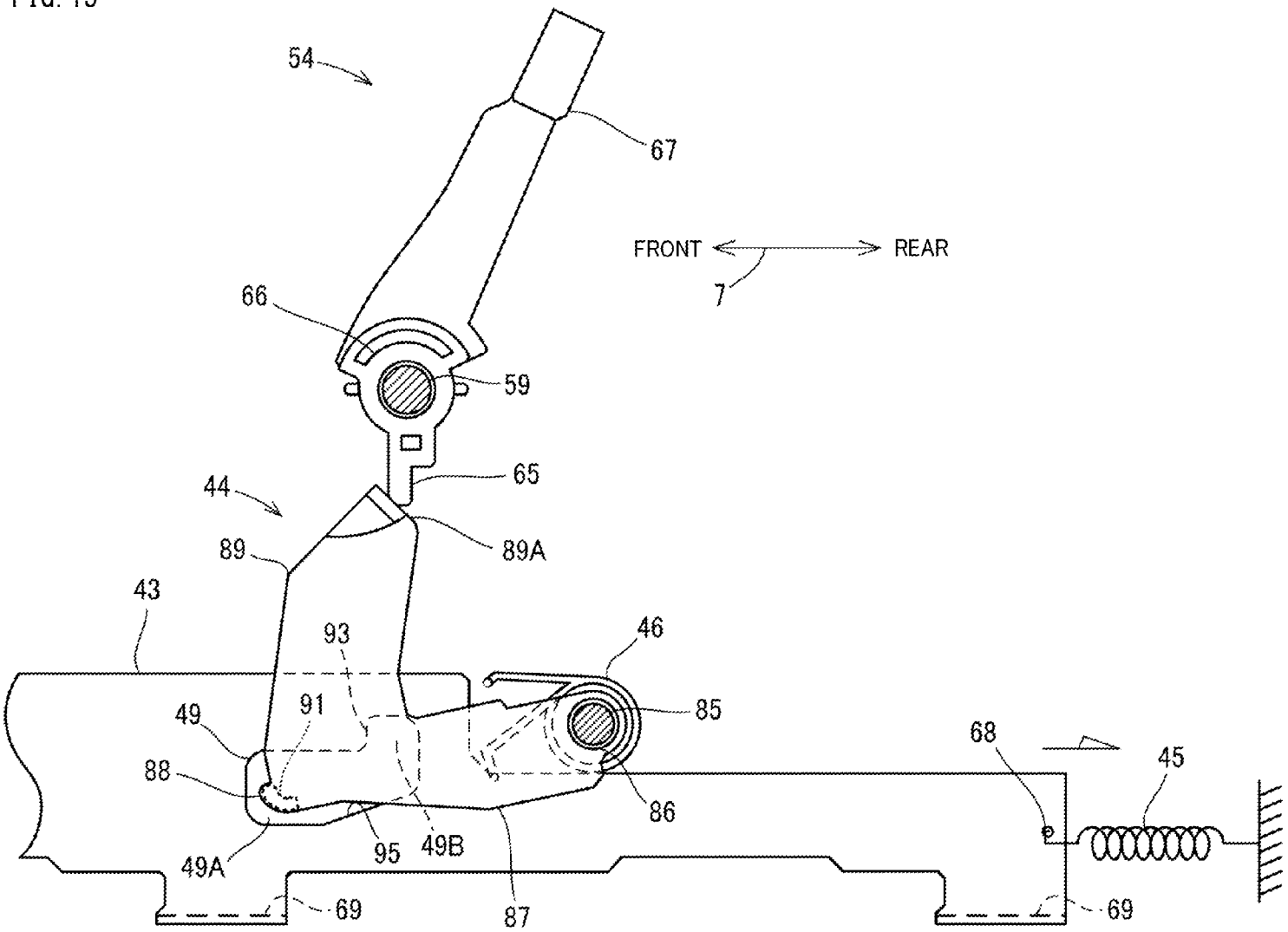
FIG. 13 is a schematic diagram for explaining the positional relationship among the operation portion, moving member and opening/closing member, and the opening/closing operation of the opening/closing member.

On the other hand, as shown in FIG. 13, when the operation portion 54 is disposed at the second attitude, the projection 65 abuts on the abutting portion 89A. This allows the moving member 44 to receive a force from the projection 65, and by the received force, the moving member 44 is rotationally moved downward resisting the biasing force of the torsion coil spring 46 and is disposed at the second pivoting position (the position shown in FIG. 13).

In addition, the moving member 44 is configured to cause the opening/closing member 43 to move from the second closing position to the second opening position based on the operation position (the first attitude or the second attitude) of the operation portion 54. Specifically, as shown in FIG. 9, a projecting piece 91 (an example of the projection portion of the present disclosure) is provided at the bending portion 88 of the moving member 44, wherein the projecting piece 91 projects toward the opening/closing member 43. Furthermore, the opening/closing member 43 has the opening portion 49 to which the projecting piece 91 is to be inserted. The projecting piece 91 and the opening portion 49 realize a lock mechanism that locks the opening/closing member 43 to be held at the second closing position, or releases the lock state to move the opening/closing member 43 to the second opening position. This lock mechanism holds the opening/closing member 43 at the second closing position resisting the biasing force of the coil springs 45 by coupling the projecting piece 91 with the opening portion 49. In addition, the lock mechanism releases the lock state of the projecting piece 91 and the opening portion 49 when the moving member 44 is dislocated to the second pivoting position in conjunction with the operation of the operation portion 54. When the lock state is released, the opening/closing member 43 is moved from the second closing position to the second opening position by the biasing force of the coil springs 45, and the opening 39A is opened.

As shown in FIG. 11, the opening portion 49 includes a second opening 49A and a first opening 49B, wherein the second opening 49A extends in the front-rear direction 7, and the first opening 49B extends from the rear of the second opening 49A upward. In other words, the first opening 49B has a shape of extending in the up-down direction 6, and the second opening 49A is formed continuously from the first opening 49B to extend long frontward (in the direction of closing the opening/closing member 43) from the first opening 49B. As a result, in the state where the projecting piece 91 is disposed at the first opening 49B, the opening/closing member 43 is pulled by the coil springs 45 and thereby the projecting piece 91 is coupled with a front edge 93 of the first opening 49B. This allows the opening/closing member 43 to be held at the second closing position without moving to the second opening position if it receives the biasing force of the coil springs 45. That is, the opening 39A of the toner supply portion 39 is maintained to be closed by the opening/closing member 43. At this state, the moving member 44 is disposed at the first pivoting position. In other words, when the moving member 44 is at the first pivoting position, the projecting piece 91 enters the first opening 49B and is coupled with the edge 93 thereof. As described above, the moving member 44 is disposed at the first pivoting position when the operation portion 54 is at the first closing position. As a result, when the operation portion 54 is at the first closing position, the moving member 44 is disposed at the first pivoting position, and the opening/closing member 43 is held at the second closing position.

Figure 12:
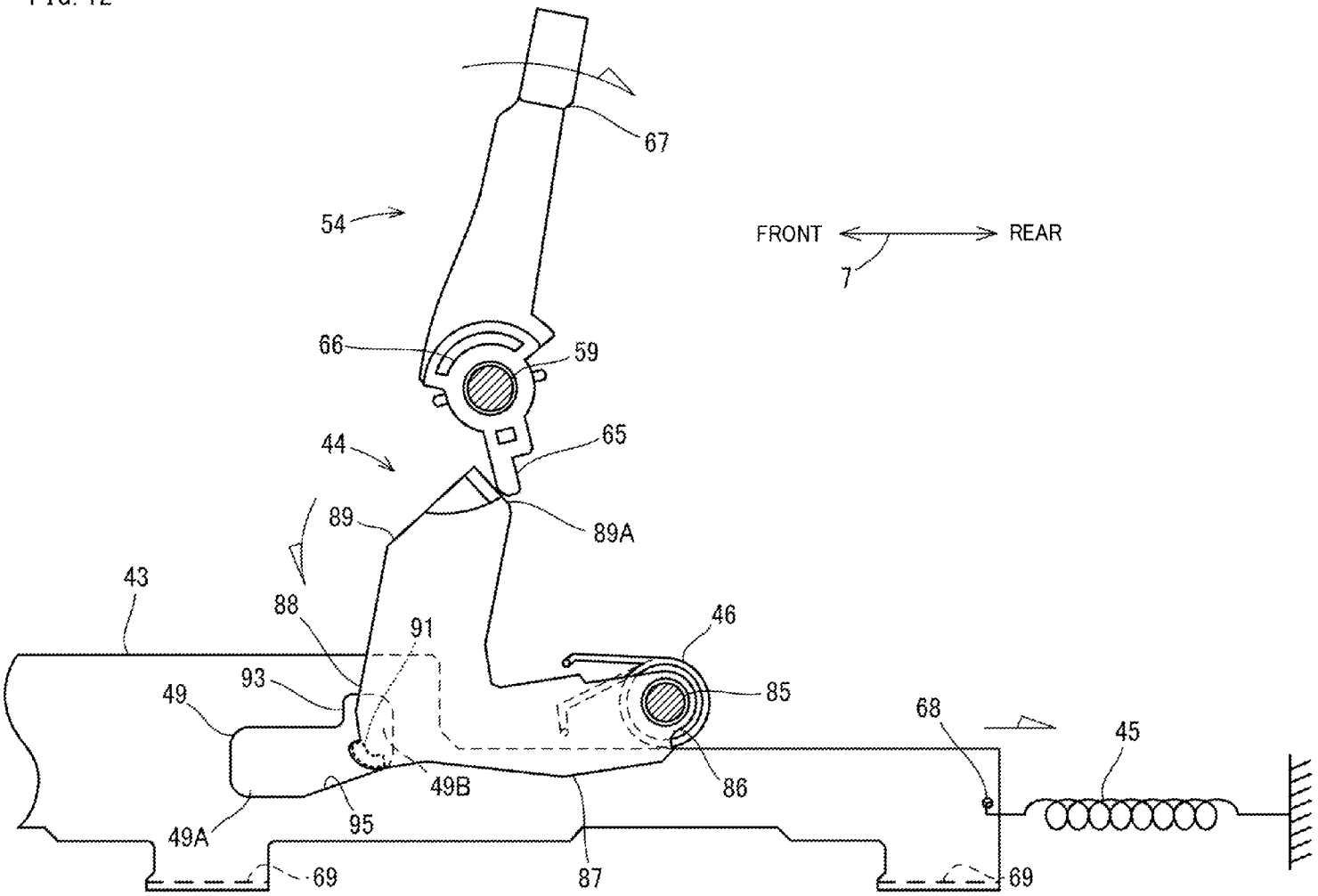
FIG. 12 is a schematic diagram for explaining the positional relationship among the operation portion, moving member and opening/closing member, and the opening/closing operation of the opening/closing member.

On the other hand, as shown in FIG. 12, when the moving member 44 is rotationally moved downward in conjunction with the operation of the operation portion 54, the projecting piece 91 is moved from the first opening 49B to the second opening 49A in conjunction with the rotational movement of the moving member 44. That is, when the operation portion 54 is operated (rotationally moved) from the first attitude to the second attitude, the moving member 44 pressed by the operation portion 54 is rotationally moved to be dislocated from the first pivoting position to the second pivoting position. At this time, the projecting piece 91 moves from the first opening 49B to the second opening 49A. That is, when the moving member 44 is at the second pivoting position, the projecting piece 91 is disposed in the second opening 49A. This allows the coupling of the projecting piece 91 and the edge 93 to be released. When the moving member 44 is disposed at the second pivoting position, the projecting piece 91 is freed. That is, the projecting piece 91 enters the second opening 49A and is disposed there with no restriction. As a result, the opening/closing member 43, receiving the biasing force of the coil springs 45 toward the second opening position, moves from the second closing position to the second opening position without restriction of the projecting piece 91. This allows the opening 39A of the toner supply portion 39 to be opened. As described above, when the operation portion 54 is at the second attitude, the moving member 44 is disposed at the second pivoting position. In this way, when the operation portion 54 is operated from the first attitude to the second attitude, the moving member 44 is dislocated from the first pivoting position to the second pivoting position in conjunction with the operation of the operation portion 54, and the opening/closing member 43 is moved from the second closing position to the second opening position. It is noted that, as described above, when the operation portion 54 is operated from the first attitude to the second attitude, the cylinder 61 of the opening/closing mechanism 53 is rotated from the first closing position to the first opening position, and the toner discharge outlet 52 is opened.

When the attitude of the operation portion 54 is returned from the second attitude to the first attitude while the opening/closing member 43 is disposed at the second opening position, the toner discharge outlet 52 is closed. At this time, the moving member 44 intends to be rotationally moved to the first pivoting position by the biasing force of the torsion coil spring 46. However, since the projecting piece 91 is disposed in the second opening 49A, the projecting piece 91 abuts on the upper end of the second opening 49A. This prevents the rotational movement of the moving member 44. In that case, the opening/closing member 43 can be manually moved from the second opening position to the second closing position. This allows the projecting piece 91 to enter the first opening 49B and the moving member 44 to be rotationally moved upward. With such operation, the opening/closing member 43 is returned to the second closing position again and the opening 39A is closed. It is noted that a transmission mechanism may be provided to transmit, to the opening/closing member 43, a rotational force that is applied when the operation portion 54 is returned from the second attitude to the first attitude such that the opening/closing member 43 is returned to the second closing position in conjunction with an operation of the operation portion 54 from the second attitude to the first attitude. In that case, the transmission mechanism is configured to transmit, by a one-way clutch, a gear or the like, only the rotational force of returning the operation portion 54 from the second attitude to the first attitude, to the opening/closing member 43.

Here, as shown in FIG. 12, the opening portion 49 has a slant portion 95. The slant portion 95 is formed at the peripheral of the second opening 49A, specifically at a corner connecting a lower end and a rear end of the second opening 49A. The slant portion 95 allows the opening/closing member 43 to be moved rearward and dislocated from the second closing position to the second opening position even when the biasing force toward the rear side is not applied to the opening/closing member 43 due to, for example, an operation failure of the coil springs 45. Specifically, when the operation portion 54 is rotationally moved from the first attitude to the second attitude and the moving member 44 is moved downward, the projecting piece 91 is moved downward. At this time, the projecting piece 91 abuts on the slant portion 95, and the projecting piece 91 applies a force to the slant surface of the slant portion 95 to move the opening/closing member 43 toward the rear side. When the slant portion 95 receives the force, the opening/closing member 43 is moved from the second closing position to the second opening position.

Meanwhile, according to the conventional configuration in which the operation portion 54 is provided in the attachment portion 34 to which the toner container 50 is attached, the operation portion 54 is configured to interfere with the toner container 50 when the opening 39A of the toner supply portion 39 is closed. According to this configuration, either the toner containers 50 or the attachment portion 34 might be damaged due to the interference. In addition, when the image forming apparatus 10 is to be stored for a long period with no toner container 50 attached thereto, the opening 39A of the toner supply portion 39 is closed to prevent inclusion of foreign materials. In that case, when unused toner containers 50 are required to be stored together with the image forming apparatus 10, the toner containers 50 cannot be stored in the attachment portion 34, and thus a space for storing the toner containers 50 needs to be provided. In addition, when the image forming apparatus 10 and the toner containers 50 are required to be packed in the same package, a space for locating the toner containers 50 needs to be provided in the package. In that case, it is impossible to make the package compact. With the above-described configuration of the intermediate transfer unit 22 and the image forming apparatus 10 of the present embodiment, it is possible to improve the convenience of the workers and users who handle or use the image forming apparatus 10.

In the present embodiment, it is possible to move the opening/closing member 43 from the second closing position to the second opening position by means of the moving member 44 that is dislocated in conjunction with the movement of the operation portion 54. As a result, it is possible to attach the toner container 50 to the attachment portion 34 in the state where the opening 39A of the toner supply portion 39 is closed and, of course, the toner discharge outlet 52 is closed. With this configuration, when unused toner containers 50 are required to be stored together with the image forming apparatus 10, the toner containers 50 can be stored in the attachment portion 34, and thus a space for storing the toner containers 50 can be reduced. In addition, when the image forming apparatus 10 and the toner containers 50 are required to be packed in the same package, it is not necessary to generate a space for keeping the toner containers 50 in the package, and thus possible to make the package compact. Furthermore, since the opening 39A of the toner supply portion 39 and the toner discharge outlet 52 can be opened at the same time by operating only the operation portion 54, convenient handling and operation of the toner containers 50 are provided.

The present embodiment describes, as one example, a configuration where the moving member 44 is rotationally moved around the spindle 85 and dislocated in conjunction with the movement of the operation portion 54. However, the present disclosure is not limited to this configuration. The moving member 44 is not limited to the above-described support mechanism and shape, but may be any mechanism as far as it can be dislocated in conjunction with the movement of the operation portion 54 so as to move the opening/closing member 43 from the second closing position to the second opening position.

The present embodiment describes, as one example, a configuration where the opening/closing member 43 is pulled toward the second opening position by the coil springs 45. However, the present disclosure is not limited to this configuration. For example, in the case where the opening/closing member 43 is pulled toward the second closing position by the coil springs 45, if the slant portion 95 is provided, it is possible to move the opening/closing member 43 from the second closing position to the second opening position resisting the biasing force of the coil springs 45, in conjunction with the movement of the operation portion 54. In this case, when the operation portion 54 is returned to the first attitude, the opening/closing member 43 is returned to the second closing position by the biasing force.

The present embodiment describes, as one example, a configuration where the first communication openings 38, openings 39A of the toner supply portions 39, toner conveyance passage 36, opening/closing member 43, moving member 44 and the like are loaded on the right end part of the intermediate transfer unit 22. However, the present disclosure is not limited to this configuration. For example, the toner conveying device of the present disclosure may include the first communication openings 38, openings 39A of the toner supply portions 39, toner conveyance passage 36, opening/closing member 43, moving member 44 and the like in a frame member that is independent of the intermediate transfer unit 22.

The present embodiment describes an example case where the moving member 44 is provided in the image forming apparatus 10 to which four toner containers 50 can be attached and is configured to move in conjunction with only the operation portion 54 of the toner container 50A. However, the moving member 44 may be configured to move in conjunction with all operation portions of all toner containers 50. In addition, the present embodiment describes an example case where the present disclosure is applied to the image forming apparatus 10 that includes four toner containers 50. However, not limited to this, the present disclosure is applicable to an image forming apparatus that includes one toner container 50.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner conveying device for conveying toner in a toner case to a developing device, comprising:

a first communication opening configured to communicate with a toner discharge outlet formed in the toner case in a state where the toner case is attached to a predetermined attachment position, the toner case including an operation portion;

a toner supply opening through which toner is supplied to the developing device;

a toner conveyance passage connecting the first communication opening to the toner supply opening;

an opening/closing member configured to move between a closing position and an opening position such that when the opening/closing member is at the closing position, the toner supply opening is closed, and when the opening/closing member is at the opening position, the toner supply opening is opened;

a moving member configured to be dislocated in conjunction with an operation of the operation portion in such a way as to move the opening/closing member from the closing position to the opening positions;

a first elastic member configured to bias the opening/closing member toward the opening position; and a lock mechanism configured to hold the opening/closing member at the closing position resisting a biasing force of the first elastic member by coupling the moving member with the opening/closing member, and to release the opening/closing member held at the closing position when the moving member is dislocated in conjunction with an operation of the operation portion, wherein the moving member is pivotable between a first pivoting position and a second pivoting position, the lock mechanism includes:

an opening portion formed in the opening/closing member; and a projection portion projecting from the moving member and inserted in the opening portion and configured to be movable inside the opening portion in conjunction with a movement of the moving member, wherein when the moving member is positioned at the first pivoting position, the projection portion is coupled with an edge of the opening portion, thereby the opening/closing member is held at the closing position resisting the biasing force of the first elastic member, and when the moving member moves to the second pivoting position in conjunction with an operation of the operation portion, the coupling of the projection portion with the edge of the opening portion is released, thereby the opening/closing member is moved to the opening position by the biasing force of the first elastic member.

2. The toner conveying device according to claim 1, wherein a plurality of toner cases can be respectively attached to a plurality of attachment positions, a plurality of toner supply openings are provided at positions respectively corresponding to the plurality of toner cases respectively attached to the plurality of attachment positions, and the opening/closing member is configured to be operated to open and close the plurality of toner supply openings.

3. The toner conveying device according to claim 1 further comprising:

a conveyance member configured to convey, to the toner supply opening, toner that was supplied from the toner case to the toner conveyance passage via the first communication opening.

4. An image forming apparatus comprising:

the toner conveying device according to claim 1;

an attachment portion configured to attach the toner case to the attachment position; and the developing device configured to develop a toner image on an image carrier by using toner conveyed by the toner conveying device.

5. The image forming apparatus according to claim 4 further comprising:

a transfer portion including a transfer belt that carries the toner image transferred from the image carrier, wherein the attachment portion is provided on an upper part of the transfer portion, and the toner conveying device is provided at a side of the transfer portion.

6. The image forming apparatus according to claim 5 further comprising:

a cover member attached to the side of the transfer portion in a state where the cover member covers the opening/closing member, the cover member having a support surface in which a second communication opening communicating with the developing device is formed at a position corresponding to the toner supply opening, wherein the opening/closing member includes a lid that is slidable on the support surface, and when the opening/closing member moves to the closing position, the lid covers the second communication opening, and when the opening/closing member moves to the opening position, the lid recedes from the second communication opening.

7. The image forming apparatus according to claim 4, wherein the attachment portion is configured to attach a plurality of toner cases corresponding to a plurality of colors.

8. A toner conveying device for conveying toner in a toner case to a developing device, comprising:

a first communication opening configured to communicate with a toner discharge outlet formed in the toner case in a state where the toner case is attached to a predetermined attachment position, the toner case including an operation portion;

a toner supply opening through which toner is supplied to the developing device;

a toner conveyance passage connecting the first communication opening to the toner supply opening;

an opening/closing member configured to move between a closing position and an opening position such that when the opening/closing member is at the closing position, the toner supply opening is closed, and when the opening/closing member is at the opening position, the toner supply opening is opened;

a moving member configured to be dislocated in conjunction with an operation of the operation portion in such a way as to move the opening/closing member from the closing position to the opening position;

a first elastic member configured to bias the opening/closing member toward the opening position; and a lock mechanism configured to hold the opening/closing member at the closing position resisting a biasing force of the first elastic member by coupling the moving member with the opening/closing member, and to release the opening/closing member held at the closing position when the moving member is dislocated in conjunction with an operation of the operation portion, wherein the moving member is pivotable between a first pivoting position and a second pivoting position, the lock mechanism includes:

an opening portion formed in the opening/closing member; and a projection portion projecting from the moving member and inserted in the opening portion and configured to be movable inside the opening portion in conjunction with a movement of the moving member, the opening portion includes:

a first opening; and a second opening formed continuously from the first opening and longer than the first opening in a direction in which the opening/closing member moves, wherein when the moving member is positioned at the first pivoting position, the projection portion is disposed at the first opening and coupled with an edge of the first opening, thereby the opening/closing member is held at the closing position, and when the moving member moves to the second pivoting position in conjunction with an operation of the operation portion, the projection portion is disposed in the second opening and the coupling is released.

9. The toner conveying device according to claim 8, wherein the operation portion is operated between a position for opening and a position for closing the toner discharge outlet in a state where the toner case is attached to the attachment position, and the moving member is pivotable between the first pivoting position where the projection portion is disposed at the first opening and coupled with the edge of the first opening and the second pivoting position where the projection portion is disposed in the second opening, and the moving member is disposed at the first pivoting position when the operation portion is at the position for closing the toner discharge outlet, and the moving member is rotationally moved from the first pivoting position to the second pivoting position in conjunction with an operation of the operation portion to the position for opening the toner discharge outlet.

10. The toner conveying device according to claim 9 further comprising:

a slant portion formed at a peripheral of the second opening and configured to abut on the projection portion while the projection portion is moved toward the second opening in conjunction with a rotational movement of the moving member to the second pivoting position, and receive, from the projection portion, a force that moves the opening/closing member to the opening position.

11. The toner conveying device according to claim 9 further comprising:

a second elastic member configured to bias the moving member toward the first pivoting position.

* * * * *

UNITED STATES PATENT AND TRADEMARK OFFICE

CERTIFICATE OF CORRECTION

PATENT NO. : 9,280,091 B2
APPLICATION NO. : 14/616963
DATED : March 8, 2016
INVENTOR(S) : Takashi Morita It is certified that error appears in the above-identified patent and that said Letters Patent is hereby corrected as shown below:

In the claims, column 17, line 12, delete “positions” and insert --position--.

Signed and Sealed this
Twenty-first Day of June, 2016

Michelle K. Lee

Michelle K. Lee
*Director of the United States Patent and Trademark Office*